United States Patent [19]

Gray

[11] Patent Number: 5,069,284

[45] Date of Patent: Dec. 3, 1991

[54] WEAR RESISTANT ROD GUIDE

[75] Inventor: Kenneth W. Gray, Odessa, Tex.

[73] Assignee: Joe C. McQueen, Jr., Odessa, Tex. ; a part interest

[21] Appl. No.: 613,239

[22] Filed: Nov. 14, 1990

[51] Int. Cl.[5] ..... E21B 17/10; E21B 37/00

[52] U.S. Cl. ..... 166/311; 166/241

[58] Field of Search ..... 166/173, 176, 311, 241; 175/325

[56] References Cited

U.S. PATENT DOCUMENTS 4,640,349 2/1987 Allen ..... 166/241 X 4,858,688 8/1989 Edwards et al. ..... 166/241

*Primary Examiner*—William P. Neuder

*Attorney, Agent, or Firm*—Wendell Coffee

[57] ABSTRACT

Apparatus and method for protecting a producing oil well's sucker rod string from wear as the rod string reciprocates in the well's tubing string. Each rod guide has a network of passages encased within the body of the rod guide. As the sucker rods and rod guides move up and down through the tubing string, produced fluid is channeled through tunnels in the passages to exit ports from which the fluids are discharged at high velocity away from the guide. The fluid exits with suffficient force to push the rod string away from the tubing string at each exit port. In this way the streams of fluid tend to centralize the rod string near the center of the tubing string thereby averting contact between not only the rod string and the tubing string, but also between the guide itself and the tubing string. The discharged fluid also provides lubrication between the guide and tubing string in the event that contact between the components does occur. Additionally, the pressure under which the fluid is discharged from the guide is sufficiently strong to dislodge scale and deposits that have adhered to the interior surface of the tubing string thereby cleaning said interior surface down to a clean and smooth flow facilitating surface.

15 Claims, 2 Drawing Sheets

WEAR RESISTANT ROD GUIDE

RIGHTS TO INVENTIONS UNDER FEDERAL RESEARCH

There was no federally sponsored research and development concerning this invention.

BACKGROUND OF THE INVENTION (1) Field of the Invention

This invention relates to rod-pumped producing oil wells. More specifically the invention relates to wear impeding sucker rod guides. Those having ordinary skill in the art are oil field workers responsible for repair and maintenance of producing oil wells, and oil company mechanical management associated with the operation of these wells.

(2) Description of the Related Art

One of several methods for removing crude oil from beneath the ground employs a pump-jack located on the surface of the ground above an oil reservoir. The pump-jack is connected to a down-hole pump at the bottom of a producing oil well using a sucker rod string. The sucker rod string comprises many sucker rods, each rod connected end-to-end by a coupling. The entire rod string extends down into a tubing string that is contained within well casing. The well casing is permanently installed during the drilling of the oil well. The tubing string serves as a conduit for produced fluid.

Cyclical upward and downward motion of the pump-jack is communicated to a down-hole pump located at the lower end of the tubing string. In response, the pump forces produced fluid collected at the bottom of the well up the tubing string to the ground's surface. The fluid acts as a lubricating bath for the rod string. Lubrication is derived from the fluid because it is a mixture including crude oil and water. Ultimately, the fluid is then stored near the well until it is removed for refining.

The sucker rod string reciprocates inside the tubing string as a result of the upward and downward motion of the pump-jack to which the rod string is fastened. Due to deflections of both the tubing string and the rod string, contact may occur between the two components. Even though the lubricating bath of crude oil is present, wear is incurred by the rod string when contact is made with the tubing string. The rod couplings typically have the largest outer diameter of the different components of the rod string and therefore incur the most wear.

Included in the crude oil are dissolved salts, gases, and undissolved minerals. When these come between the rods, couplings, and tubing, abrasion and corrosion occur. Through time, abrasion and corrosion will lead to parting of the rod string and holes in the tubing string When a hole develops in a tubing string, pressure inside the tubing string will be lost. Crude oil will then be pumped into the annulus created between the tubing and casing, instead of to the surface for collection.

When a sucker rod parts, a rod coupling breaks, or holes are created in the tubing string, either or both of the sucker rods or tubing must be pulled from the well and inspected for damage. Defective rods and tubing must be replaced. The resultant pulling unit costs and down-time of the well are a great expense to the pumping unit operator. For these reasons, methods for reducing or eliminating these periods of down-time are of great benefit to the owners.

A well known method of preventing wear to the rods and tubing string is the use of sucker rod guides, also known as centralizers. Rod guides have a greater outer diameter than all other parts of the rod string. As such, the guides act as a sacrificial and protective element by retarding wear and by incurring any wear that does occur.

The rod guides are normally attached at three or four locations on each sucker rod but may be used in as many as six locations per rod or as few as one per rod. As such, the guides act as a sacrificial and protective buffer between the rod string and the tubing string. Wear occurs to the guide as it protects the rod string and results in a reduction of the guide's protective thickness.

The wearing effect suffered by the guides will cause the guides to eventually have an outer diameter similar to that of other parts of the rod string. Then guides will not buffer contacts between the rod string and the tubing string. These types of rod guides must be periodically replaced.

Sucker rod guides having two different methods of installation are currently available; those that are manually fastened about the sucker rod and those that are injection molded in place about the sucker rod. Both type of guides are formed from wear resistant plastic materials. These materials currently include: polyphenylene sulfide, NYLON, polyethylene, polypropylene, polycarbonate, polyester and acetal. The manually installed rod guides permit installation in the field. The injection molded rod guides are installed in a factory before the sucker rods are transported to the well site.

There are several known designs of existing rod guides. One version comprises a solid ring-shaped guide that is fixed about the sucker rod. The guide extends outwardly away from the exterior surface of the sucker rod toward the tubing string. Fluid flow channels through the body of the guide are often provided. Otherwise, the guide's thickness significantly impedes the upward flow of produced fluid.

Another known version of the rod guide includes a cylindrically shaped guide similar to that described in the paragraph above. The circumferential surface of this guide is fluted so that oil passes through the depressions of the scalloped surface. The ridges between each depression provide the greatest outer diameter of the guide and serve as the buffering contact surface against the tubing string.

Another design includes wheels along the circumferential surface of a cylindrical guide. The wheels are oriented so that they roll as the rod string reciprocates within the tubing string in the event of contact between the wheels and the tubing string.

A drawback of the first two described designs is that contact between the guide and the tubing string does occur and these guides eventually wear down and must be replaced. Additionally, minerals, paraffins, and other elements contained in the produced oil may adhere to the guides. These deposits may cause clogging to the channels through which it is intended for the produced oil to flow. The wheeled design may also become fouled with mineral scale and paraffin deposits so that the wheels no longer rotate and begin to wear.

Two additional designs are illustrated in FIGS. 2 and 3 of the included drawings. FIG. 2 shows a known style rod guide 21 that is used in the oil field today. The general shape of the guide 21 is cylindrical with ridges about the exterior surface. The long axis of each ridge is parallel to the long axis of sucker rod 12. There are depressions between each ridge that act as channels along the guide for the produced fluid 24 as it is pumped up tubing string 16. An example of this configuration is shown in U.S. Pat. No. 4,343,518 to Pourchot.

FIG. 3 shows another known sucker rod guide 23 that is also presently used in the oil field. The outer diameter of the rod guide 23 in this style is smaller than the outer diameter of the guide 21 found in FIG. 2. As can be seen in FIG. 3, the guide's 23 outer diameter is sufficiently large to prevent contact between the rod string and the tubing string, but it is small enough to allow fluid to pass by the guide. Each guide shown in FIGS. 2 and 3 protect the sucker rod and allows the produced fluid to flow upwards in the tubing string. The common detriment of both guides is that each incurs deteriorative wear and must be periodically replaced.

Before this application was filed, the applicant was aware of these additional United States Patents:

2,166,116 BETTIS
4,043,410 BENNET
4,690,229 RANEY.

BENNETT shows an anti-sticking tool for drilling pipe designed to redirect drilling fluid so that said fluid prevents the drill string from sticking to the well bore.

RANEY shows a radially stabilized drill bit that has means for stabilizing the drill bit as the bit is rotating while making hole.

BETTIS shows a well casing protector that has grooves. Said grooves concurrently act as impellers and channels for drilling fluid. The protector's impelling action throws drilling fluid outwardly against the casing from the protector which is attached to the drilling string.

The above three referenced devices are all used in conjunction with a drilling string during the digging of a well, not with the rod string of a producing oil well.

SUMMARY OF THE INVENTION (1) Progressive Contribution to the Art

All rod guides take advantage of the lubricating characteristic of produced fluid inside the tubing string merely because the guides operate within said fluid. A rod guide of this invention likewise uses the produced fluid to lubricate contact between the guides and the tubing string. Additionally, the guide channels the fluid through passages in the guide's body and jets the fluid at a high velocity radially away from the sucker rod. This jetting of the fluid away from the guide and against the tubing string provides two benefits.

The first benefit is that the crude oil is jetted from the guide with sufficient force to push the guide away from the tubing string at the point the jet leaves the guide. By pushing the sucker rod away from the tubing string, most wearing contact between the sucker rod string and the tubing string is avoided.

The passages within the guide are arranged so that there is an equal circumferential distance between each jet's point of exit about the outside circumferential surface of the guide. The effect of this equal spacing is a positioning of the rod near the center of the tubing string during normal operation. This centering effect is also referred to as centralizing the rod string.

In the event that the guide does deviate from center and approaches the tubing string, the jets closest to the tubing string will exert the most force away from the tubing string. The resulting forces created by all the ports tends to push the rod back toward the center of the tubing string until those resulting forces come to equilibrium.

The second benefit of the invention is its provision of a wear impeding slick buffer of lubricating fluid between the guide and tubing string.

A further benefit of this device is that the jet streams blast away scale and other deposits on the interior surface of the tubing string. The jetting action cleans the surface so that undisturbed flow is facilitated as the produced fluid is pumped.

In one embodiment of this invention the jet streams exit the guide radially in a direction that is normal to the long axis of the guide. This orientation provides the strongest centralizing forces because nearly all of the force generated by each stream tends to push the guide straight back to the center of the tubing string.

In another embodiment of the invention, the exit ports direct the fluid jet stream away from the guide at an upward angle. The angled configuration induces an upwardly helical flow pattern in the fluid thereby assisting the fluid's upward movement as well as removing deposits from the interior surface of the tubing string.

The primary benefit of this invention is that the guide not only serves as a buffer between the sucker rods and the tubing string, but it also averts contact between the guide itself and the tubing string. For this reason, the guides deteriorate at a much slower rate than the known guides previously disclosed. Additionally, the longevity of these guides and the added protection they afford to both the rod string and tubing string provide great savings to the owner of a producing oil well. These savings are realized in reduced repair and maintenance expenses and a reduction in the loss of revenue associated with down time.

(2) Objects of this Invention

An object of this invention is to provide a sucker rod guide that averts contact between the sucker rod string and the tubing string of a producing oil well.

Another object of this invention is to provide a sucker rod guide that averts contact between the guide and the tubing string by jetting a portion the produced fluids away from the guide under pressure and thereby reducing wear to the guide.

Another object of this invention is to dispense lubricating produced fluid between the guide and tubing string as the sucker rod string reciprocates within the tubing string.

Another object of the invention is to provide a sucker rod guide that cleans mineral scale and paraffin deposits from the interior surface of the tubing string.

Further objects are to achieve the above with a device that is sturdy, compact, durable, simple, ecologically compatible, and reliable, yet inexpensive and easy to manufacture and maintain.

Other objects are to achieve the above with a method that is rapid, ecologically compatible, efficient, and inexpensive, and does not require highly skilled people to implement.

The specific nature of the invention, as well as other objects, uses, and advantages thereof, will clearly appear from the following description and from the accompanying drawings, the different views of which are not necessarily scale drawings.

Figure 1:
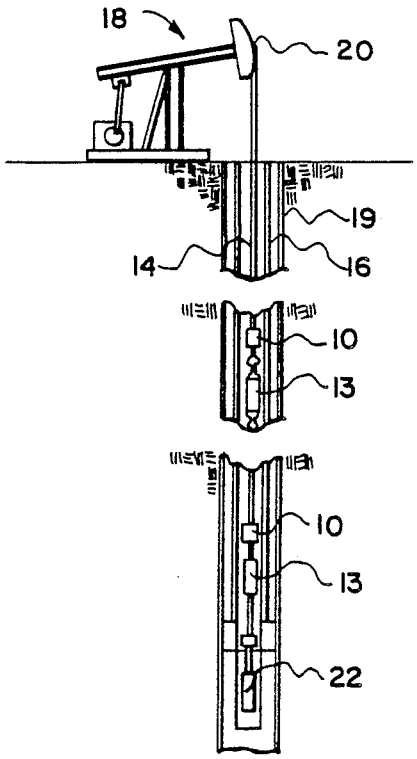
FIG. 1 is a longitudinal section of a rod pumped producing oil well.
Figure 2:
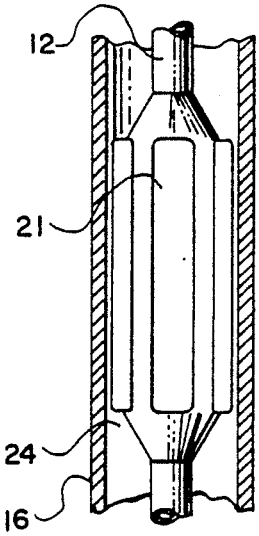
PRIOR ART FIG-2
FIG. 2 shows a previously known rod guide.
Figure 3:
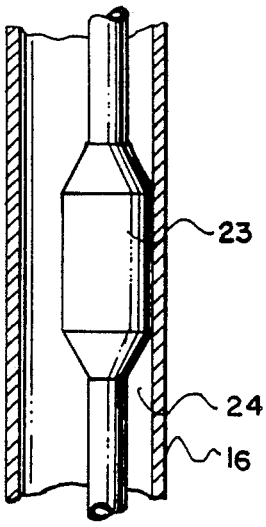
PRIOR ART FIG-3
FIG. 3 shows another previously known rod guide.

As an aid to correlating the terms of the claims to the exemplary drawings, the following catalog of elements is provided:

sucker rod guide
sucker rod
coupling
sucker rod string
tubing string
oil well
well casing
pump jack
previous style rod guide
pump
previous style rod guide
produced fluid
body
bottom tunnels
outside circumferential surface
entry ports
top surface
bottom surface
38 nozzle
39 exit port
40 exterior surface
41 clearance space
42 interior surface
43 space

DESCRIPTION OF THE PREFERRED EMBODIMENTS

Oil well 18 may be seen in FIG. 1 with pump-jack 20 located on the surface of the ground. The pump-jack 20 is connected to sucker rod string 14 that extends down into tubing string 16. The sucker rod string 14 ultimately attaches to pump 22 located at a bottom end of the tubing string 16. The sucker rod string 14 comprises many sucker rods 12 which are connected end to end by couplings 13. Well casing 19 is exterior of the tubing string 16 and creates a cylindrical hole for the tubing string 16 to be extended down to an oil producing geological formation. Produced fluid 24, which includes a mixture of crude oil, water and other elements collects at the bottom of the tubing string 16 about the pump 22.

The pump 22 is powered by the pump-jack 20 which vertically reciprocates the sucker rod string 14 within the tubing string 16. During one pump cycle consisting of an upward and downward stroke of the pump-jack 20, fluid 24 is pushed toward the ground's surface.

In the above described configuration, the tubing string 16 may not extend absolutely straight down from the pump-jack 20 or the sucker rod string 14 may deflect within the tubing string 16. When either or both of these situations occur there is the possibility that there will be a wearing contact between the sucker rod string 14 and the tubing string 16. Sucker rod guides are used to prevent contact between the two strings 14 and 16. The above described structure is well known to those associated with oil production.

Figure 4:
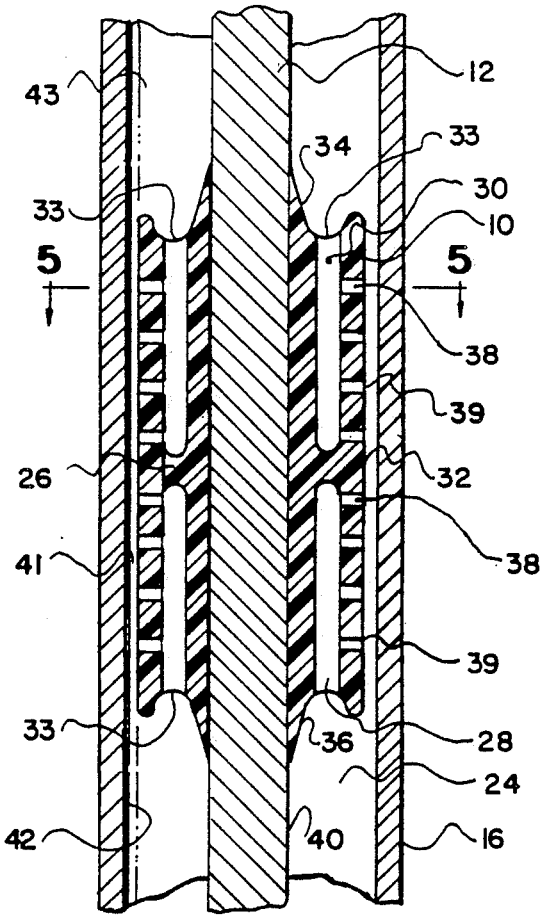
FIG. 4 is a longitudinal section of a rod guide in place according to this invention.
Figure 5:
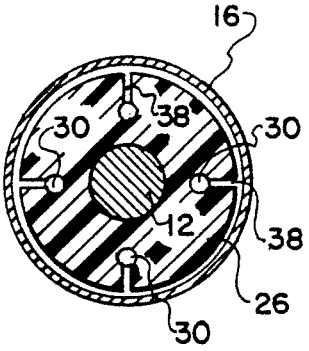
FIG. 5 is a cross-section of the rod guide taken on line 5–5 of FIG. 4.
Figure 6:
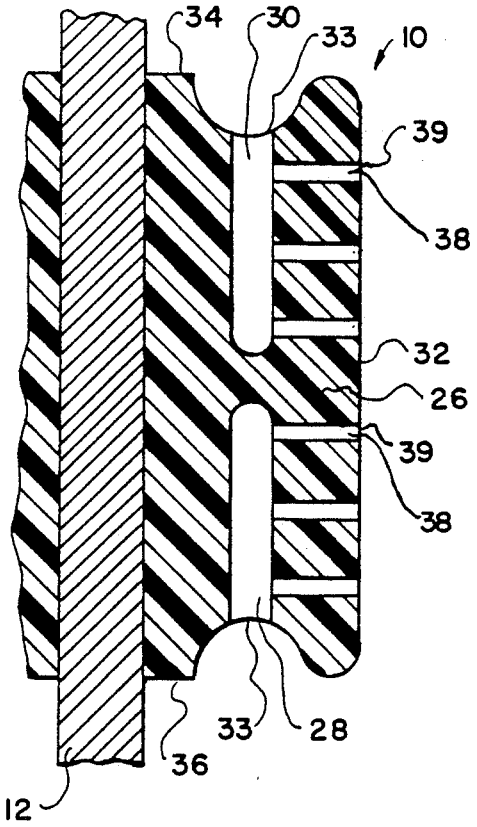
FIG. 6 is a longitudinal section of one-half of the rod guide of FIG. 4 showing details of construction.
Figure 7:
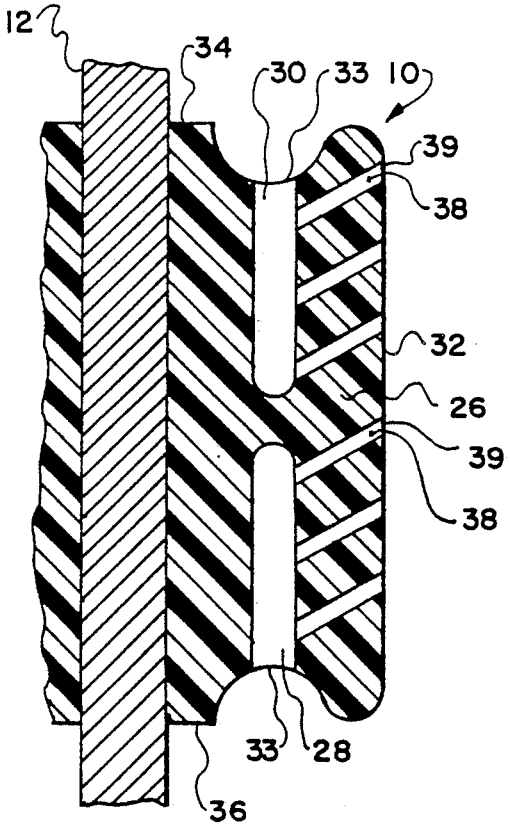
FIG. 7 is a longitudinal section of one-half of the rod guide similar to FIG. 6 showing a second embodiment.

Sucker rod guide 10 of this invention, may be seen in longitudinal cross-section in FIG. 4. The sucker rod guide 10 is cylindrical in shape and fixed about the sucker rod 12. There are two means for fixing the sucker rod guide 10 to the sucker rod 12; both means are presently used with other rod guides. Two halves of the guide 10 may be coupled together about an exterior surface 40 of the rod 12 sufficiently tight to prevent the guide 10 from sliding along the length of the rod 12. The other means is to injection mold the guide 10 to the rod 12 in place so that the guide 10 bonds directly to the rod's surface.

Body 26 of the guide 10 is formed so that the guide 10 contains a network of passages comprising entry ports 33, top tunnels 30, bottom tunnels 28, nozzles 38 and exit ports 39 as shown. The passages are encased entirely within the body 26 of the guide.

Each tunnel is cylindrically shaped and has a long axis parallel to a long axis of the sucker rod 12 and a long axis of the guide 10. The top tunnels 30 extend from a top surface 34 of the guide 10 toward a bottom surface 36 of the guide for a distance less than one-half the guide's 10 total length. Said top tunnels 30 are open to the produced fluid 24 at the top surface 34. The bottom tunnels 28 extend from the bottom surface 36 of the guide toward the top surface 34 of the guide likewise for a distance less than one-half the guide's 10 total length. Said bottom tunnels 28 are open to the produced fluid 24 at the bottom surface 36. No significantly voluminous tunnels extend from the top surface 34 completely through the body 26 of the guide 10 to the bottom surface 36.

A thickness of the guide 10 measured radially from the exterior surface 40 of the rod 12 is greater than one-half the difference between an interior radius of the tubing string 16 and an exterior radius of the rod 12. Stated otherwise, the guide's thickness is more than one-half the difference in the radii. A thickness of about three-fourths of the difference of the radii is preferred. There is an annular clearance space 41 between an outside circumferential surface 32 of the guide 10 and an interior surface 42 of the tubing string 16 when the rod 12, guide 10 and tubing 16 are co-axial. The thickness of this annular space 41 is less than the thickness of the guide 10.

One or more nozzles 38 are located along the length of each tunnel connecting said tunnel with the outside circumferential surface 32 of the guide 10. At one end the nozzle 38 opens to its tunnel, while at the other end the nozzle opens through an aperture or exit port 39 to the clearance space 41. The exit port 39 is located at the outside circumferential surface 32 of the guide 10. In the embodiment shown in FIG. 4 of the invention, the nozzles 38 are oriented so that an axis of each nozzle 38 is perpendicular to the long axis of its tunnel. The exit ports 39 are positioned within the guide 10 so that there is an equal circumferential distance between each consecutive exit port 39.

The top tunnels 30 provide means for channeling the produced fluid 24 downward, relative to the guide 10, in a direction parallel to the long axis of the rod string 14. Produced fluid 24 passes through the top tunnels 30 from the top surface 34 of the guide 10 during an upward stroke of the rod string 14. The bottom tunnels 28 provide means for channeling the produced fluid 24 upward, relative to the guide 10, in a direction parallel to the long axis of the rod string 14. Produced fluid 24 passes through the bottom tunnels 28 from the bottom surface 36 of the guide 10 during a downward stroke of the rod string 14. From the tunnels, the fluid 24 flows into the nozzles 38. While in the nozzle 38, the fluid is channeled radially away from the long axis of the guide to the outside circumferential surface 32 of the guide.

The top and bottom surfaces 34 and 36 of the guide 10 are formed so as to create the entry ports 33 that scoop fluid 24 into the top tunnels 30 and bottom tunnels 28. Only a small amount of fluid 24 passes around the guide 10 as said guide 10 is pushed through the fluid 24. This occurs because the clearance space 41 is narrow. Most of the produced fluid 24 is funneled into the tunnels by the scooping entry ports 33. Because flow of the fluid 24 around the guide 10 is restricted, hydraulic pressure is created ahead of the guide 10 and causes the fluid 24 to enter the tunnels under pressure. As a result, the fluid 24 is scooped into the top tunnels 30 on an upward stroke of the rod string 14 and into the bottom tunnels 28 on a downward stroke of the rod string through the entry ports 33. The fluid 24 flows from the tunnels into and through the nozzles 38, and then out of the guide 10 at the exit ports 39. The fluid 24 leaves the guide under high velocity causing said fluid 24 to be jetted from the exit ports 39 in a jet.

In the embodiment shown in FIG. 4, the fluid jet leaves the guide 10 in a direction that is normal to the long axis of the guide 10. The force created by the jet on the guide 10 is in the opposite direction of the direction that the jet leaves the guide. Said force tends to push the guide 10 and the sucker rod string 14 away from the tubing string 16 at the exit port 39 through which the jet left the guide 10. The jet strikes the interior surface 42 of the tubing string 16 at an angle that is perpendicular to a long axis of the tubing string. Upon contact of the jet with the tubing string 16, the force of the jet dislodges adhering scale and other deposits from the tubing's interior surface 42. By keeping the interior surface 42 of the tubing string 16 smooth and clean, upward flow of produced fluid 24 is facilitated.

It is also contemplated that the nozzle's 38 long axis can be oriented so that it is at an angle upward from perpendicular to the guide's 10 long axis. In this angled configuration, the jet leaves the guide 10 at the same angle to perpendicular and strikes the interior surface of the tubing string 42 at a similar angle. The angled jet exerts a lesser force on the guide 10 and rod string 14 away from the tubing string 16 than does the nozzle that is oriented at a right angle to the long axis of the guide 10. The angled jet does, however, provide means for assisting upwardly helical flow in the fluid 24 as the fluid 24 moves up the tubing string 16.

The embodiments shown and described above are only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The method of preventing wear between a sucker rod string and a tubing string of a producing oil well by using a. a series of sucker rods connected end to end forming a sucker rod string, b. said sucker rod string extending down into a tubing string of a producing oil well from c. a pump jack located on the surface of the ground above the tubing string to d. a pump located at a bottom end of the tubing string, e. said pump forces produced fluid collected at the bottom end of the tubing string u to the ground's surface, f. said produced fluid occupies a space between the rod string and the tubing string through which the fluid is channeled from the bottom end of the tubing string to the ground's surface, and g. said pump jack raises and lowers the rod string in the fluid being pumped up the tubing string while said fluid bathes the rod string within the tubing string wherein the improved process includes the following procedure in combination with the above:

h. forming a sucker rod guide with passages encased within a body of the guide, j. fixing the guides to the sucker rod string along the rod string's length, k. channeling a portion of the fluid contained in the tubing string through the passages within the body of the guide outwardly away from the rod string to an outside circumferential surface of the guide, l. jetting the fluid toward the tubing string from the guide as the rod string reciprocates within the tubing string, thereby m. pushing the rod string away from the tubing string at the guide, and n. averting contact between the rod string and the tubing string.

2. The invention as defined in claim 1 further comprising o. lubricating any guide-to-tubing string contact that does occur by p. dispensing the produced fluid between the guide and the tubing string thus q. forming a slick buffer between the guide and tubing string thereby r. reducing wear to the guide and tubing.

3. The invention as defined in claim 1 further comprising o. opening top tunnels in the passages at a top surface of the guide to the fluid, p. scooping fluid from within the space between the rod string and tubing string into the top tunnels on an upstroke thereby performing said channeling of the fluid during an upward stroke of the rod string, and q. having bottom tunnels open in the passages at a bottom surface of the guide to the fluid, r. scooping fluid from within the space between the rod string and tubing string into the bottom tunnels on a downstroke thereby performing said channeling of the fluid during a downward stroke of the rod string, s. flowing the fluid from the tunnels through nozzles to the outside circumferential surface of the guide.

4. The invention as defined in claim 1 further comprising o. said jetting of said fluid against an interior surface of the tubing string is with sufficient force thereby p. dislodging scale and other deposits that build-up on said interior surface and thereby q. facilitating flow of the fluid being pumped up the tubing string by r. keeping the interior surface of the tubing string smooth and clean.

5. A sucker rod guide used in combination with:

a. a series of sucker rods connected end to end forming a sucker rod string, b. said sucker rod string extending down into a tubing string of a producing oil well from c. a pump jack located on the surface of the ground above the tubing string to d. a pump located at a bottom end of the tubing string, e. said pump forces produced fluid collected at the bottom end of the tubing string up to the ground's surface, f. said produced fluid occupies a space between the rod string and the tubing string through which the fluid is channeled from the bottom end of the tubing string to the ground's surface, g. said pump jack raises and lowers the rod string in the fluid being pumped up the tubing string while said fluid bathes the rod string within the tubing string, wherein the improvement comprises the following structure in combination with the above:

h. said guide fitted on said sucker rod string and having passages encased within a body of the guide with the passages having j. top tunnels and bottom tunnels, each tunnel having a long axis parallel to a long axis of the rod string, k. said top tunnels open to the fluid in the tubing string at entry ports located at a top surface of the guide, l. said bottom tunnels open to the fluid in the tubing string at entry ports located at a bottom surface of the guide, m. the top tunnels and the bottom tunnels separate from one another thereby preventing the fluid from flowing directly through the guide, and n. at least one nozzle connected to each tunnel and said nozzles are oriented so that an extension of a center axis of each of the nozzles extends away from the guide.

6. The invention as defined in claim 5 further comprising o. said guide having an initial thickness, p. said initial guide thickness is more than one-half the difference between an interior radius of the tubing string and an exterior radius of the rod thereby leaving q. a clearance space between the guide and the tubing string through which a portion of the fluid within the tubing string is allowed to pass.

7. The invention as defined in claim 5 further comprising o. said center axis of each nozzle is normal to said long axis of the rod string.

8. The invention as defined in claim 7 further comprising p. each of said nozzles terminate in q. an exit port located at an outside circumferential surface of the guide that jets the fluid in stream against an interior surface of the tubing string.

9. The invention as defined in claim 8 wherein said tunnels and nozzles are oriented within the guide so that there is equal circumferential distance between each consecutive exit port with said distance measured along a line about the outside circumferential surface of the guide in a plane normal to the guide's long axis.

10. The invention as defined in claim 9 further comprising r. said guide having an initial thickness, s. said initial guide thickness is more than one-half the difference between an interior radius of the tubing string and an exterior radius of the rod thereby leaving t. a clearance space between the guide and the tubing string through which a portion of the fluid within the tubing string is allowed to pass.

11. The invention as defined in claim 5 further comprising o. said center axis of each nozzle is at an upward angle from a line perpendicular to p. the long axis of the sucker rod.

12. The invention as defined in claim further comprising q. each of said nozzles terminate in r. an exit port located at an outside circumferential surface of the guide that jets the fluid in streams against an interior wall of the tubing string at a angle.

13. The invention as defined in claim 12 wherein said tunnels and nozzles are oriented within the guide so that there is equal circumferential distance between each consecutive exit port with said distance measured along the outside circumferential surface of the guide in a plane normal to the guide's long axis.

14. The invention as defined in claim 13 wherein said nozzles and said exit ports are part of means for assisting upwardly helical flow in the fluid about the guide and the rod string.

15. The invention as defined in claim 14 further comprising s. said guide having an initial thickness, t. said initial guide thickness is more than one-half the difference between an interior radius of the tubing string and an exterior radius of the rod thereby leaving u. a clearance space between the guide and the tubing string through which a portion of the fluid within the tubing string is allowed to pass.

* * * * *